United States Patent [19]

Platek

[11] Patent Number: 4,901,723

[45] Date of Patent: Feb. 20, 1990

[54] DEPILATORY DEVICE

[75] Inventor: Avner Platek, Tel Aviv, Israel

[73] Assignee: Securicome Development Inc., Geneva, Switzerland

[21] Appl. No.: 277,713

[22] Filed: Nov. 30, 1988

[51] Int. Cl.[4] ..... A61B 17/00

[52] U.S. Cl. ..... 606/133

[58] Field of Search ..... 128/355; 17/11.1 R, 17/47

[56] References Cited

U.S. PATENT DOCUMENTS 4,079,741 3/1978 Daar et al. ..... 128/355

4,726,375 2/1988 Gross et al. ..... 132/73.6 X

*Primary Examiner*—Michael H. Thaler

*Attorney, Agent, or Firm*—Charles E. Baxley

[57] ABSTRACT

A depilatory device comprises a housing having a side adapted to be juxtaposed with an area from which hair is to be pulled and an elastically bendable bar having at least one edge formed with a plurality of slits opening generally parallel to the side. The slits normally are closed and the bar is bendable to open the slits. A drive in the housing periodically flexes the bar generally parallel to the side and thereby opens and closes the slits so that hairs engaged in the slits when open are trapped when the slits close and can then be pulled out by moving the housing and bar relative to the area from which the hair sprouts.

8 Claims, 10 Drawing Sheets

DEPILATORY DEVICE

FIELD OF THE INVENTION

The present invention relates to a depilatory device for cosmetic purposes. More particularly this invention concerns a device which removes hair by pulling it out, as opposed to cutting it off.

BACKGROUND OF THE INVENTION

A conventional depilatory device works by grabbing and pulling out hairs. As described in U.S. Pat. No. 2,900,661 such a machine may use helical spring which define hair-catching gaps. Complex rotary action opens and closes the gaps to allow hairs to be grasped and pulled out. Similarly in U.S. Pat. Nos. 1,232,617, 4,079,741, and 4,524,772 helical and arcuate springs are used and in U.S. Pat. No. 4,726,375 a flexible slit cylinder is used to form hair-grasping slits that are used to pull out the hair.

All such devices are relatively complex and have a uniaxial movement that accounts both for opening and closing the hair-grasping slits and subsequently for pulling out the hair. They work relatively crudely and often so slowly that their action is excessively painful.

OBJECTS OF THE INVENTION

It is therefore an object of the present invention to provide an improved depilatory device.

Another object is the provision of such an improved depilatory device which overcomes the above-given disadvantages, that is which is of simple construction and which operates surely and relatively painlessly.

SUMMARY OF THE INVENTION

A depilatory device according to this invention comprises a housing having a side adapted to be juxtaposed with an area of a user's body from which hair is to be pulled and an elastically deformable bar having at least one edge formed with a plurality of slits opening generally parallel to the side. The slits normally are closed and the bar is deformable to open the slits. A drive in the housing periodically flexes the bar generally parallel to the side and thereby opens and closes the slits so that hairs engaged in the slits when open are trapped when the slits close and can then be pulled out by moving the housing and bar relative to the area from which the hair sprouts.

Such a system, with the bar flexing parallel to the surface that is run over the skin being depilated, ensures extremely efficient and relatively painless depilation. The hairs are surely caught in and trapped by the slits and then pulled out.

The drive according to the invention includes a central element reciprocating parallel to the side and connected generally centrally to the bar. In a simple embodiment the bar has ends anchored fixedly on the housing.

In accordance with further features of this invention the drive further includes two side elements flanking the central element, connected to ends of the bar, and normally reciprocating oppositely to the central element. These elements are each slides movable parallel to one another. In this case the drive includes a transmission comprising a central and two side toothed wheels formed as gears meshing with one another and arranged in a line parallel to the bar, a crank connecting each wheel to the respective slide for converting rotation of each wheel into reciprocation of the respective slide, and a rotary drive motor for continuously rotating one of the wheels and thereby rotationally driving the other two wheels.

Such an arrangement has the considerable advantage that not only the opening and closing movement of the hair-grabbing slits is side-to-side, that is parallel to the skin surface being dehaired, but the movement that pulls out the hairs is also side-to-side. Thus this three-slide system is simply slowly moved over the area to be dehaired and the force of the motor alone will suffice both to grab and pull out the hairs.

The bar according to this invention can be formed of a hard elastomer or synthetic resin. In addition it normally has a pair of opposite edges each formed with a row of such slits. Thus the device can be moved in either direction perpendicular to the bar for hair removal.

According to the invention the drive includes an electric motor in the housing. An on-board rechargeable battery may power this motor, which can be a small 6 watt 500 RPM type, or it can be powered by a separate power supply.

The bar can also be a coil spring having interturn spaced forming the slits.

DESCRIPTION OF THE DRAWING

The above and other objects, features, and advantages will become more readily apparent from the following detailed description, it being understood that any feature described with reference to one embodiment of the invention can be used where possible with any other embodiment and that reference numerals or letters not specifically mentioned with reference to one figure but identical to those of another figure refer to structure that is functionally if not structurally identical. In the accompanying drawing.

SPECIFIC DESCRIPTION

Figure 1:
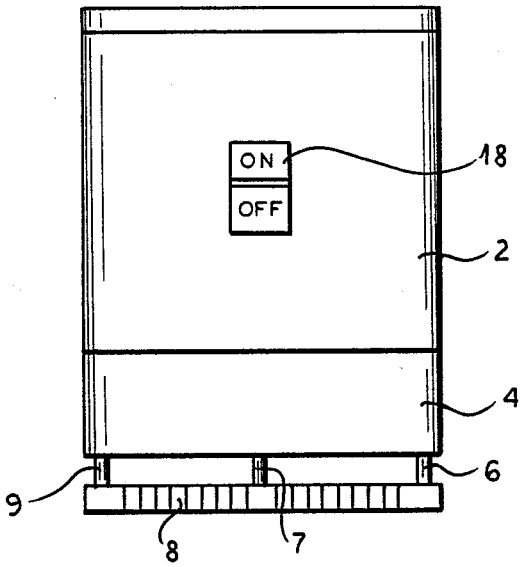
FIG. 1 is a side view of the apparatus according to this invention.

As seen in FIGS. 1, and 3 through 9, the apparatus of this invention has a basically cylindrical main housing 2 centered on an axis A and small enough to be held in the hand. This housing 2 is made of a durable synthetic resin such as acrylonitrile butadiene styrene and contains a small direct-current motor 3 turned on and off by a slide switch 18 and having an output shaft 13 projecting downward from the housing 2 on the axis A. A 6 watt 5000 RPM motor can be used, powered either from a built in battery or an external power supply. A cylindrical secondary housing 4 of the same diameter as the housing 2 is fixed by unillustrated means to the bottom of the housing 2 so that it can be removed for cleaning the unit and contains a rotary-to-reciprocating transmission constituted by a crank wheel 12 fixed to the shaft 13 and a slide 10. The wheel 12 is provided with an eccentric crank pin 5 extending parallel to but offset from the axis A and engaged in a crosswise slot 11 formed in the upper rear face of the slide 10. In turn this slide 10 has a square extension 10' that fits snugly in and is slidable in a direction perpendicular to the axis A and slot 11 in a slot cutout 14 in the bottom of the housing 4. The wheel 12 and slide 10 can be made of a hard engineering-type synthetic resin such as nylon.

Two diametrally opposite and axially downwardly projecting pins 6 and 9 symmetrically flank the cutout 14 and are fixed in the ends of an electric bar 8 extending crosswise across the slot 14 and formed on its opposite edges with blind slits 8'. This bar 8 is normally formed of a flexible but stiff elastomeric synthetic resin and can be switched with bars of different properties and/or dimensions depending on the type of hair being depilated. A pin 7 extending axially from the center of the projection 10 of the slide 10 is seated in the center of this bar 8.

Thus as illustrated in FIGS. 16A through 16D as the shaft 13 and wheel 12 rotate the slide 10 is reciprocated back and forth perpendicular to the axis A in the slot 14. This causes the slots 8' on one side 20 of the bar 8 to open and then close, and then the slots on the opposite side 21 to open and close. At the same time that these slots 8' are opening and closing, the entire device is being moved over the skin. Thus hairs caught in the slots 8' are pulled out.

Figure 2:
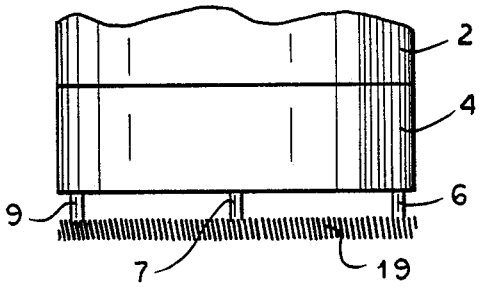
FIG. 2 is a view like FIG. 1 of a variant on the embodiment of FIG. 1.
Figure 3:
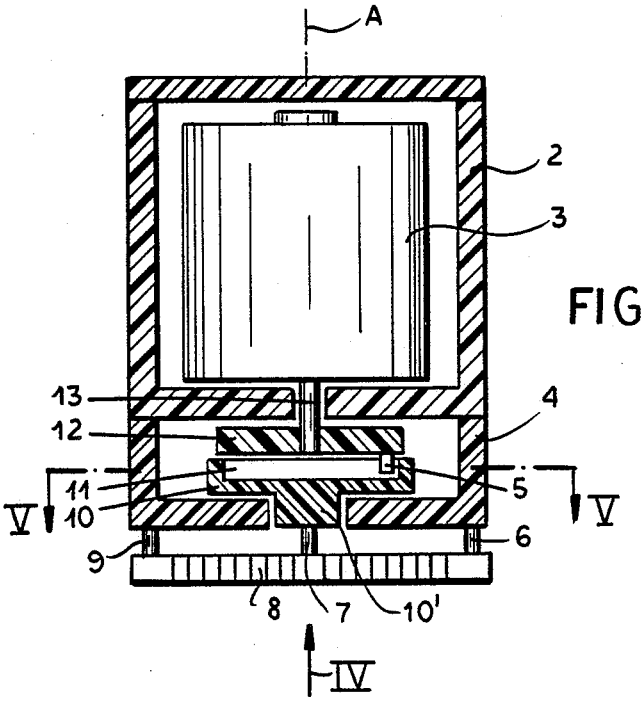
FIG. 3 is an axial section through the apparatus of FIG. 1.
Figure 4:
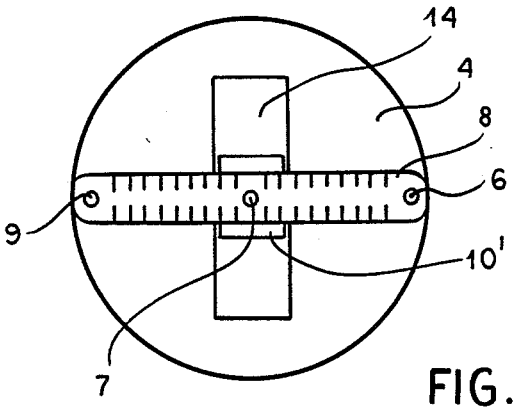
FIG. 4 is a bottom view taken in the direction of arrow IV of FIG. 3.
Figure 5:
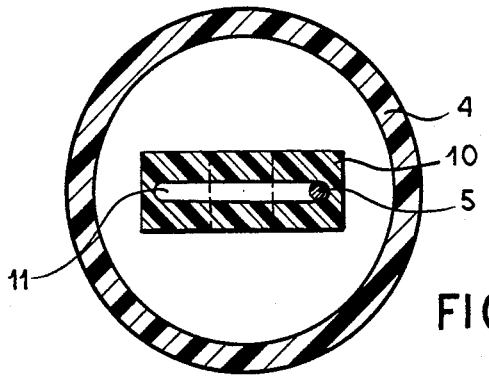
FIG. 5 is a cross section taken along line V—V of FIG. 3.
Figure 6A:
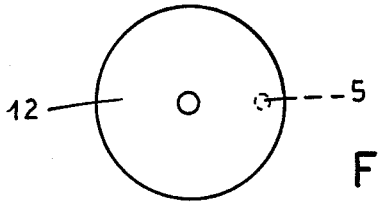
FIGS. 6A and 6B are top and side views, respectively, of the crank wheel of the apparatus.
Figure 6B:
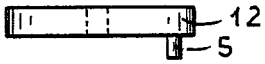
Figure 7A:
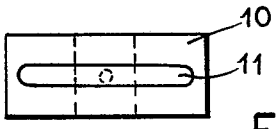
FIGS. 7A and 7B are top and side views, respectively, of the slide of the apparatus.
Figure 7B:
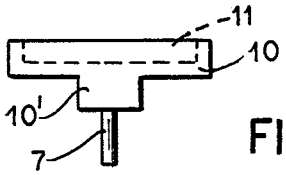
Figure 8A:
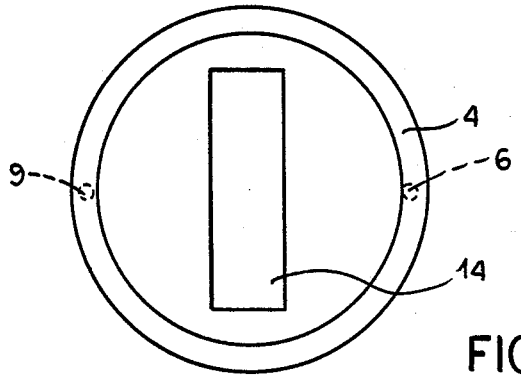
FIGS. 8A and 8B are top and side views, respectively, of the secondary housing of the apparatus.
Figure 8B:
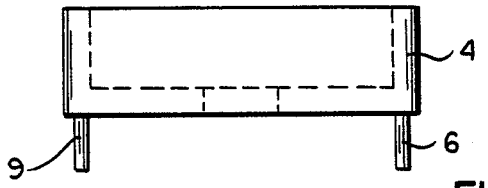
Figure 9A:
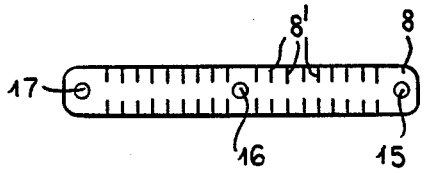
FIGS. 9A and 9B are top and side views, respectively, of the split bar of the apparatus.
Figure 9B:
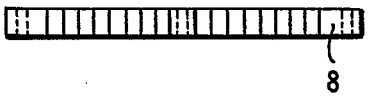
Figure 10:
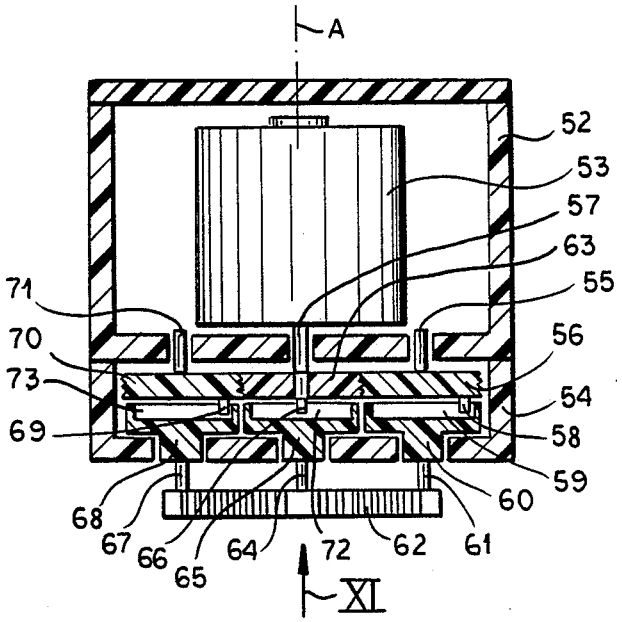
FIG. 10 is an axial section like FIG. 3 through a second embodiment of the apparatus of this invention.
Figure 11:
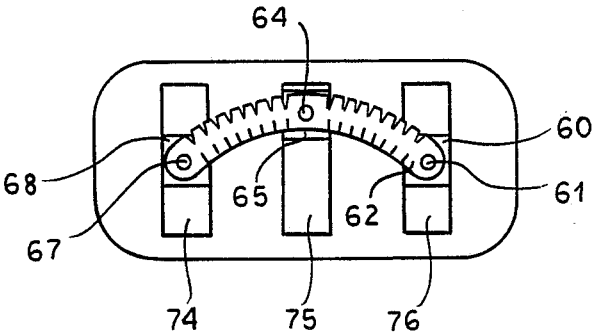
FIG. 11 is a bottom view taken in the direction of arrow XI of FIG. 10.
Figure 12A:
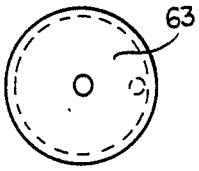
FIGS. 12A and 12B are top and side views, respectively, of the center crank wheel of the apparatus of FIG. 10.
Figure 12B:
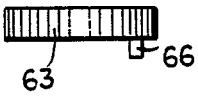
Figure 13A:
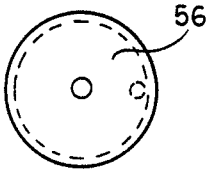
FIGS. 13A and 13B are top and side views, respectively, of one of the side crank wheels of the apparatus of FIG. 10.
Figure 13B:
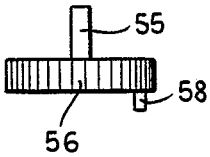
Figure 14A:
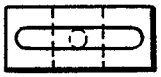
FIGS. 14A and 14B are top and side views, respectively, of one of the slides of the apparatus of FIG. 10.
Figure 14B:
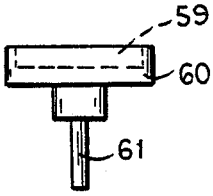
Figure 15A:
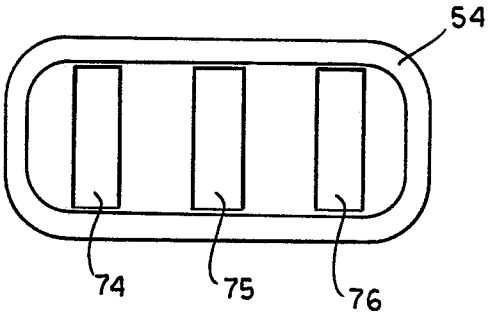
FIGS. 15A and 15B are top and side views, respectively, of the secondary housing of the apparatus of FIG. 10.
Figure 15B:
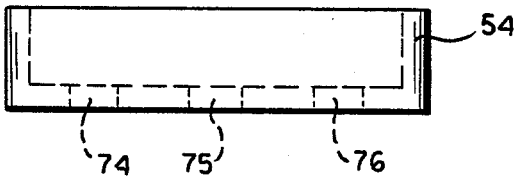
Figure 16A:
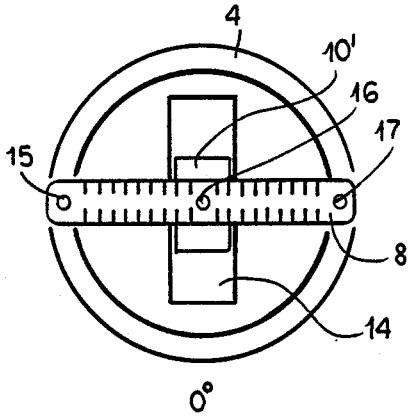
FIGS. 16A through 16D are bottom views illustrating operation of the first embodiment of FIGS. 1 and 2 through 9.
Figure 16B:
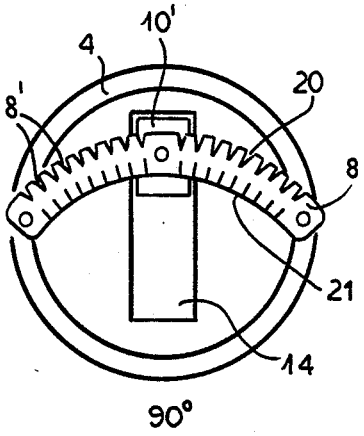
Figure 16C:
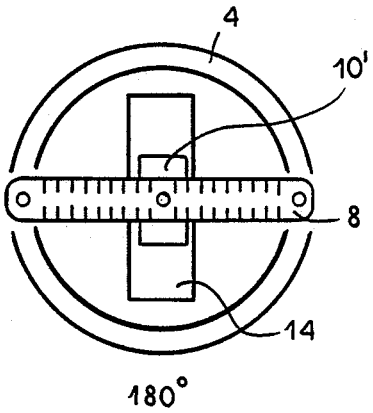
Figure 16D:
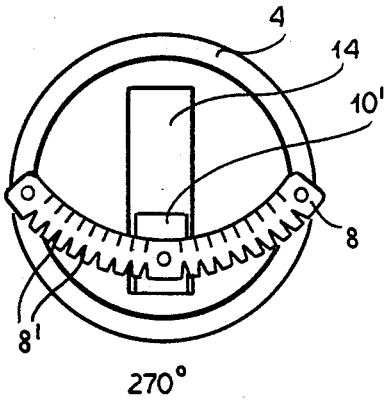

FIG. 2 shows a variation on the system of FIG. 1, where the bar 8 is replaced by a coil spring 19. The spaces between the turns of this spring 19 open and close like the slits 8' as the spring is flexed one way, then the other, so that this system works identically to that of FIG. 1.

FIGS. 10 through 15 show another system. Here a basically cylindrical main housing 52 centered on an axis A, and small enough to be held in one's hand, is substantially identical to the housing 2 of FIG. 1. This housing 52 contains a small direct-current electric motor 53 having an output shaft 57 projecting downward from the housing 55 on the axis A. A cylindrical secondary housing 54 of the same diameter as the housing 52 is fixed by unillustrated means to the bottom of the housing 52. This secondary housing 54 contains a center crank wheel 63 fixed to the shaft 57 and a pair of side crank wheels 56 and 70 diametrically flanking the wheel 63 and formed as gears meshing with external teeth on this wheel 63. These side wheels 56 and 70 are carried on short axles 55 and 71 that are journaled in the bottom end wall of the housing 52 and that diametrally and symmetrically flank the shaft 57. The wheels 56, 63, and 70 carry respective crank pins 58, 66, and 69 fitting like the pin 5 of the first embodiment in respective slots 59, 72, and 73 of slides 60, 65, and 68 slidable in respective slots 76, 75, and 74 formed in the bottom wall of the secondary housing 54. In turn these slides 60, 65, and 68 carry pins 61, 64, and 67 that are fitted in the two ends and center of another slotted bar 62 substantially identical to the bar 8 of the first embodiment.

Figure 17A:
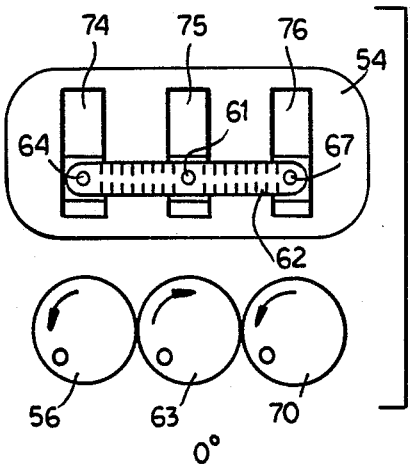
FIGS. 17A through 17H are partly diagrammatic bottom views illustrating operation of the second embodiment of FIGS. 10 through 15.
Figure 17B:
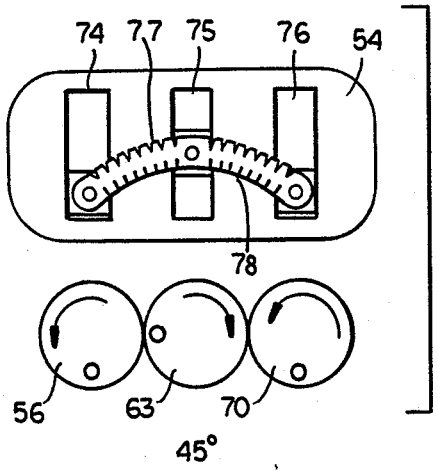
Figure 17C:
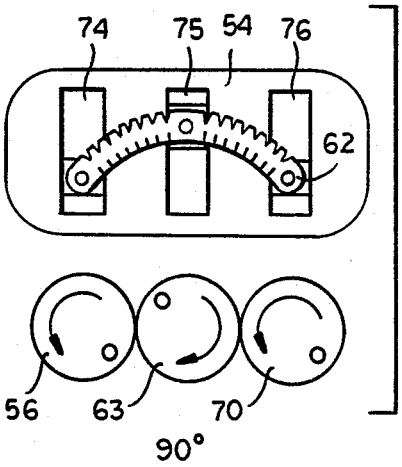
Figure 17D:
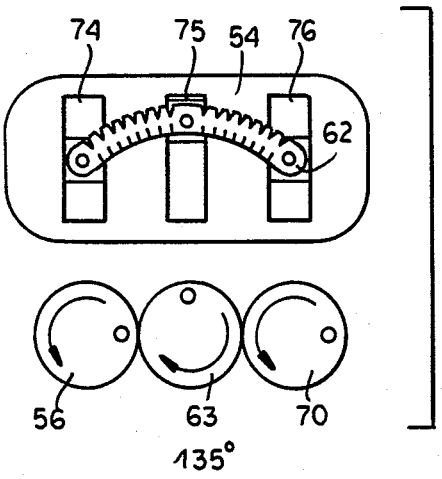
Figure 17E:
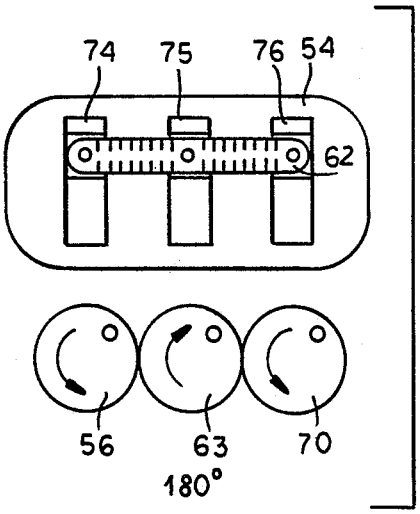
Figure 17F:
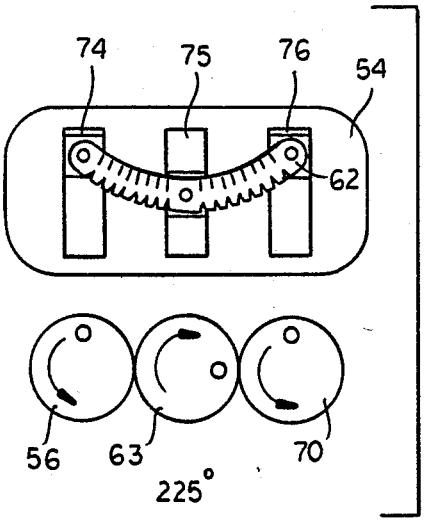
Figure 17G:
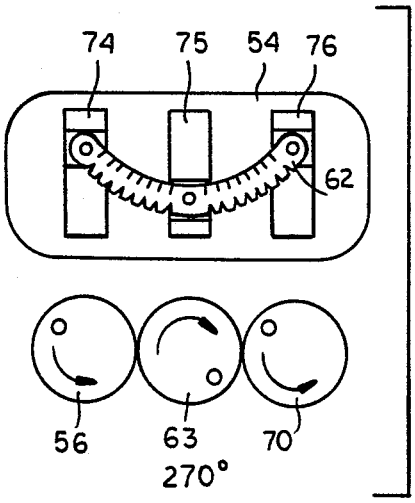
Figure 17H:
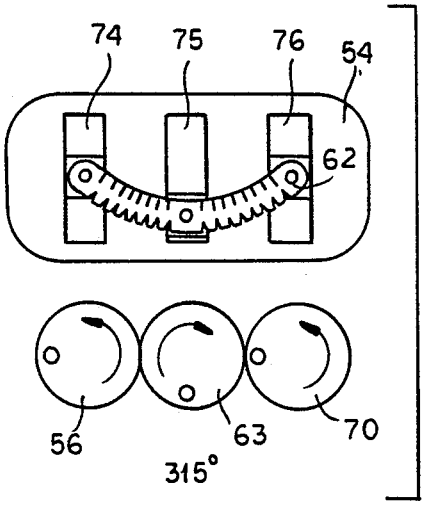

Due to the inherent rotation reversal of adjacent meshing gears, the two side wheels 56 and 70 rotate opposite to the center wheel 63, but because these wheels are all of the same diameter, they will remain in synchronism as illustrated in FIGS. 17A through 17H. Starting from the FIG. 17A position with all three pins 61, 64, and 67 in line and the bar 62 straight, they will first move into the position of FIG. 17B with one side 77 of the bar 62 stretched and its slits open and the other side 78 compressed with its slits closed. Continued rotation through the position of FIG. 17C will open the slits even more and shift the bar 62 to the side, then as shown in FIGS. 17D and 17E the bar will be straightened out on the opposite side of the apparatus. Thereupon the bending and movement is opposite as shown in FIGS. 17F, 17G, and 17H, after which everything returns to the position of FIG. 17A. This lateral sweeping movement accompanying the opening and closing of the hair-pulling slits greatly increases the hair-pulling efficiency of the device.

I claim:

1. A depilatory device comprising:

a portable housing having an outer portion adapted to be juxtaposed to an area of a user's skin from which hair sprouts, an elongated elastically bendable member having a longitudinal axis, connected to the housing at said outer portion and having at least one edge formed with a plurality of slits and the slits being normally closed, drive means in the housing for periodically bending the member laterally relative to said longitudinal axis and generally parallel to the user's skin and then reversing the direction of the bending thereby opening and closing the slits whereby some of the hairs are engaged in the slits when open are trapped when the slits close and are pulled out by moving the member relative to the user's skin.

2. The device according to claim 1 further characterized by:

the member being elongated with ends and a medial span, the drive means including a central element engaging the member at the medial span.

3. The device according to claim 2 further characterized by the ends being anchored fixedly to the housing.

4. The device according to claim 1 further characterized in that the drive means includes an electric motor in the housing.

5. The device according to claim 1 further characterized in that the member is a coiled spring having interturn spaces forming the slits.

6. A depilatory device comprising:

a portable housing having an outer portion adapted to be juxtaposed to an area of a user's skin from which hair sprouts, an elastically bendable member connected to the housing at said outer portion and having at least one edge formed with a plurality of slits and the slits being normally closed, drive means in the housing for periodically bending the member generally parallel to the user's skin and then reversing the direction of the bending thereby opening and closing the slits whereby some of the hairs are engaged in the slits when open are trapped when the slits close and are pulled out by moving the member relative to the user's skin, the member being elongated with ends and a medial span, the drive means including a central element engaging the member at the medial span, the drive means further including two side elements flanking the central element with both of the side elements connected one to each of the ends and arranged to reciprocate oppositely to the central elements.

7. The device according to claim 6 further characterized by the drive means including a transmission comprising:

a central and two side toothed wheels formed as gears meshing with one another and arranged in a line parallel to the member, crank means connecting each of the wheels to its respective element for converting rotation of each of the wheels into reciprocation of its respective element, turning means for continously rotating one of the wheels thereby rotationally driving the other two wheels.

8. The device according to claim 7 characterized further in that the member has a pair of opposite edges each formed with a row of the slits.

* * * * *